US005996354A

United States Patent [19]

Sokolean et al.

[11] Patent Number: 5,996,354

[45] Date of Patent: Dec. 7, 1999

[54] METHOD AND APPARATUS FOR COOLING A ROOM

[75] Inventors: Helmuth Sokolean, Uerikon; Klaus Roschmann, Uznach, both of Switzerland

[73] Assignee: Barcol-Air AG, Stafa, Switzerland

[21] Appl. No.: 08/860,095

[22] PCT Filed: Nov. 1, 1996

[86] PCT No.: PCT/CH96/00387

§ 371 Date: Jan. 16, 1998

§ 102(e) Date: Jan. 16, 1998

[87] PCT Pub. No.: WO97/17576

PCT Pub. Date: May 15, 1997

[30] Foreign Application Priority Data

Nov. 3, 1995 [CH] Switzerland ..... 3119/95

[51] Int. Cl.[6] ..... F24F 5/00

[52] U.S. Cl. ..... 62/80; 62/151; 62/259.1; 62/285; 62/DIG. 1; 165/49

[58] Field of Search ..... 62/80, DIG. 1, 62/259.1, 261, 298, 299, 302, 303, 286, 151, 155, 156, 157, 234, 285; 165/49, 133

[56] References Cited

U.S. PATENT DOCUMENTS

| | | | |
|---|---|---|---|
| 1,872,728 | 8/1932 | Gloekler | 62/286 |
| 2,498,342 | 2/1950 | Petticrew | 62/261 X |
| 2,651,503 | 9/1953 | Mills | 62/259.1 |
| 2,835,186 | 5/1958 | Goldsmith | 62/261 X |
| 3,611,743 | 10/1971 | Manganaro | 62/298 X |
| 4,291,542 | 9/1981 | Sminge et al. | 62/156 |
| 4,627,245 | 12/1986 | Levine | 62/157 |
| 5,216,887 | 6/1993 | Kadontani et al. | 62/3.2 |
| 5,363,908 | 11/1994 | Köster | 165/49 |
| 5,495,724 | 3/1996 | Koster | 62/259.1 |

*Primary Examiner*—Harry B. Tanner

*Attorney, Agent, or Firm*—Finnegan, Henderson, Farabow, Garrett & Dunner, L.L.P.

[57] ABSTRACT

In order to cool a room, a cooling element fitted in the ceiling region is cooled to below the freezing point, preferably to about −40° C., during the cooling phases so that condensate forming thereon freezes immediately. During regeneration phases when the room is not in use, the cooling element is defrosted and the melted condensate is caught in a condensate tray beneath the cooling element and drained via a discharge. The great temperature difference between the room to be cooled and the cooling element also makes it possible to obtain a strong cooling effect with a small cooling element, especially by indirect radiation exchange between the room and the cooling element via an intermediate ceiling. In addition, the air in the room is dehumidified since water vapor is deposited on and bonded to the cooling element in the form of ice.

28 Claims, 5 Drawing Sheets

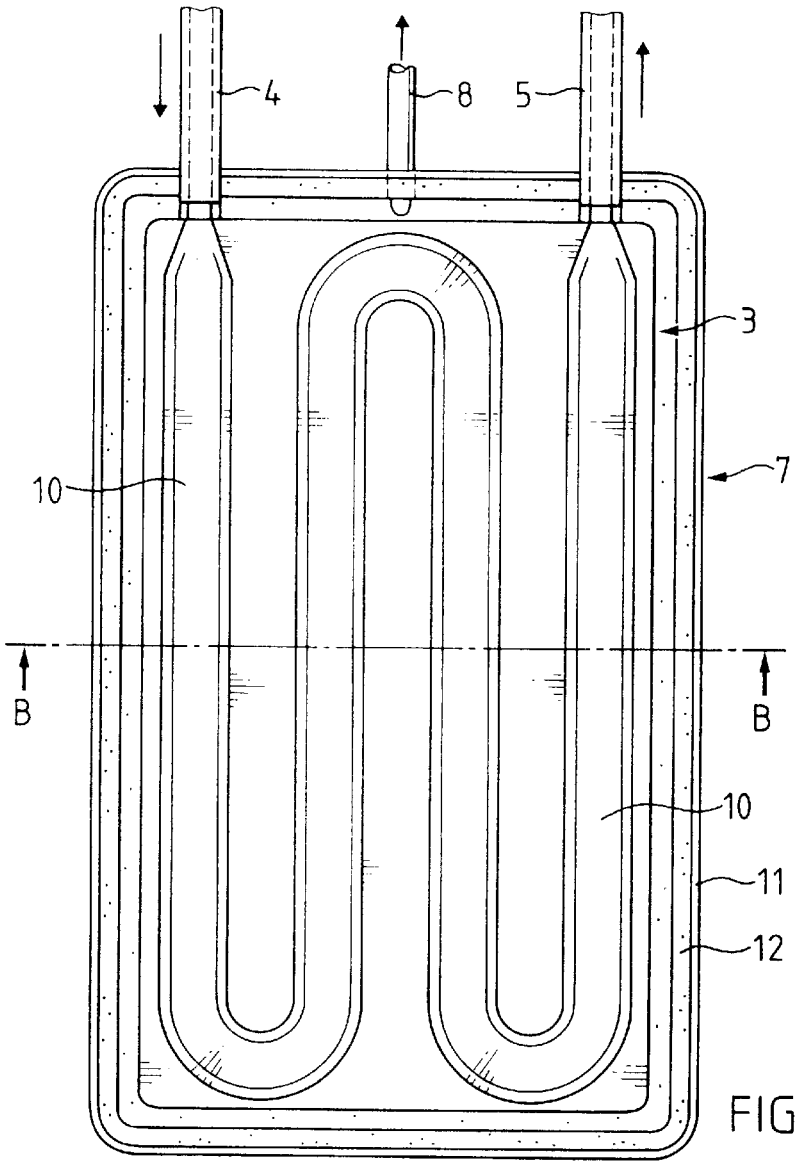
FIG. 2a
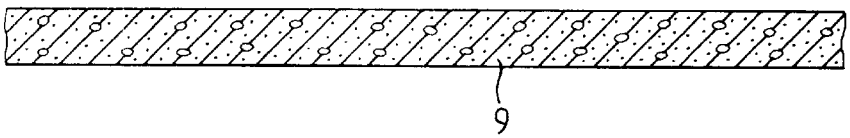
FIG. 2b
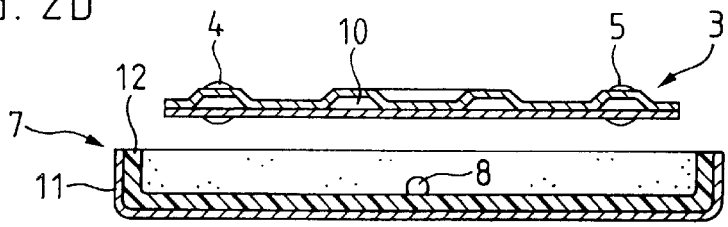

METHOD AND APPARATUS FOR COOLING A ROOM

BACKGROUND OF THE INVENTION

1. Field of the Invention

The invention relates to a method for cooling a room by radiant heat exchange and to an apparatus for carrying out the method.

2. Description of the Related Art

It is known (see for example H. Sokolean: "K ühldeckentechnologie zur Erreichung des bestmöglichen Raumkomforts", [Cooling-ceiling technology for achieving the best possible interior conditions], Architektur und Technik August 1992, p. 49–53, B+L Verlags AG, Schlieren (Switzerland)), to cool rooms by means of cooling elements which are preferably arranged in the ceiling area and through which usually there flows a heat transfer medium cooled in a central refrigerating unit. In this case, the cooling takes place by convective heat exchange of the cooling element with the air in the room and in particular by direct radiation exchange of the same with the objects located in the room.

The cooling capacity of such cooling elements is limited by the fact that their surface temperature must not drop below the dew point, since otherwise condensate forms during the cooling phases, which usually coincide with the times during which the room is in use. Although it has been proposed (WO-A-91/13 294) to cool below the dew point and to drain the condensate produced away by means of condensate channels or trays, it must be assumed that the formation of condensate during use of the climatically conditioned room is always problematical and undesired.

Also known (from DE-A-28 02 550) is a device for drying and cooling air in which the air is sucked by means of a fan over a cooling element which is temporarily cooled below the freezing point and which is freed of deposited frost by heating during short regeneration phases. However, such devices are not suitable for use in a room to be climatically conditioned and would therefore require air to be transported by forced convection, which would have to cause undesired draughts.

Since the dew point at the usually prevailing atmospheric moisture levels is around 12° C. to 15° C., if the formation of condensate is to be avoided in the case of a conventional cooling element arranged in the room to be cooled, the difference between the permissible temperature of the said element and the desired room temperature of about 22° C. is very small and the cooling capacity which can be achieved is correspondingly modest. As a result, very large cooled surfaces are required, which entails comparatively high costs and has the effect of restricting interior design possibilities.

SUMMARY OF THE INVENTION

It is the object of the invention to provide a remedy to the above limitations. The invention, as characterized in the claims, provides a method for climatically conditioning rooms in which the temperature of the cooling element is no longer restricted by the dew point. The fundamental idea here is to cool the cooling element during cooling phases, which coincide to a great extent with the times during which the climatically conditioned room is in use, to such an extent that condensate deposited on the said element quickly turns to ice and, as a result, no problematical condensation water is produced. During regeneration phases, which are generally chosen to be outside the times of use, the frozen condensate is melted off and drained away in liquid form.

The advantages achieved by the invention are particularly associated with the fact that the temperature of the cooling element can be set as low as desired. As a result, very high cooling capacities can be achieved even with small cooling surfaces, even if the heat exchange with the room to be climatically conditioned takes place exclusively by means of radiation and little, if at all, free convection. This effect is further promoted by the fact that, in the infrared range, ice has radiation properties very similar to those of a black body and the icing of the cooling element has an entirely favourable effect on the decisive direct or indirect radiation exchange with objects in the climatically conditioned room. The cooling elements can consequently be kept small and simple in construction, whereby, of course the costs are reduced and no longer play the previous restrictive role as a factor to be taken into account in interior design.

In addition, another problem is solved, one which until now presented difficulties with generic methods of climatically conditioning rooms and could only be dealt with by exchanging the air in the room, which however, requires additional installations and entails the risk of undesired draughts being produced.

In particular, if the room is being used for a considerable period of time by a high concentration of people, the humidity of the air in the room increases rapidly. This is perceived as unpleasant, and often leads to the attempt to remedy the situation by opening the windows; this however in the summer months in particular, often further aggravates the problem owing to the high humidity of the outside air. The high atmospheric humidity may finally result in, even with the cooling elements at a relatively high temperature, the risk of condensation and of the cooling system being switched off entirely by dew-point monitors. Consequently, the cooling is shut down at the very time it is needed most urgently.

By contrast, in the case of the method according to the present invention, atmospheric moisture is bound on the cooling element by icing of the condensate. As a result, the air in the room remains dry, which makes conditions considerably more comfortable and does not allow difficulties of the kind described previously to arise at all.

It is to be understood that both the foregoing general description and the following detailed description are exemplary and explanatory only and are not restrictive of the invention as claimed.

BRIEF DESCRIPTION OF THE DRAWINGS

The invention is explained in more detail below with reference to figures, which merely illustrate exemplary embodiments, in which:

FIG. 2*a* is a plan view of a first embodiment of an apparatus according to the present invention for carrying out the method according to the invention, FIG. 2*b* is a cross-section along line B—B through the apparatus of FIG. 2*a,*

DESCRIPTION OF THE PREFERRED EMBODIMENTS

Figure 1:
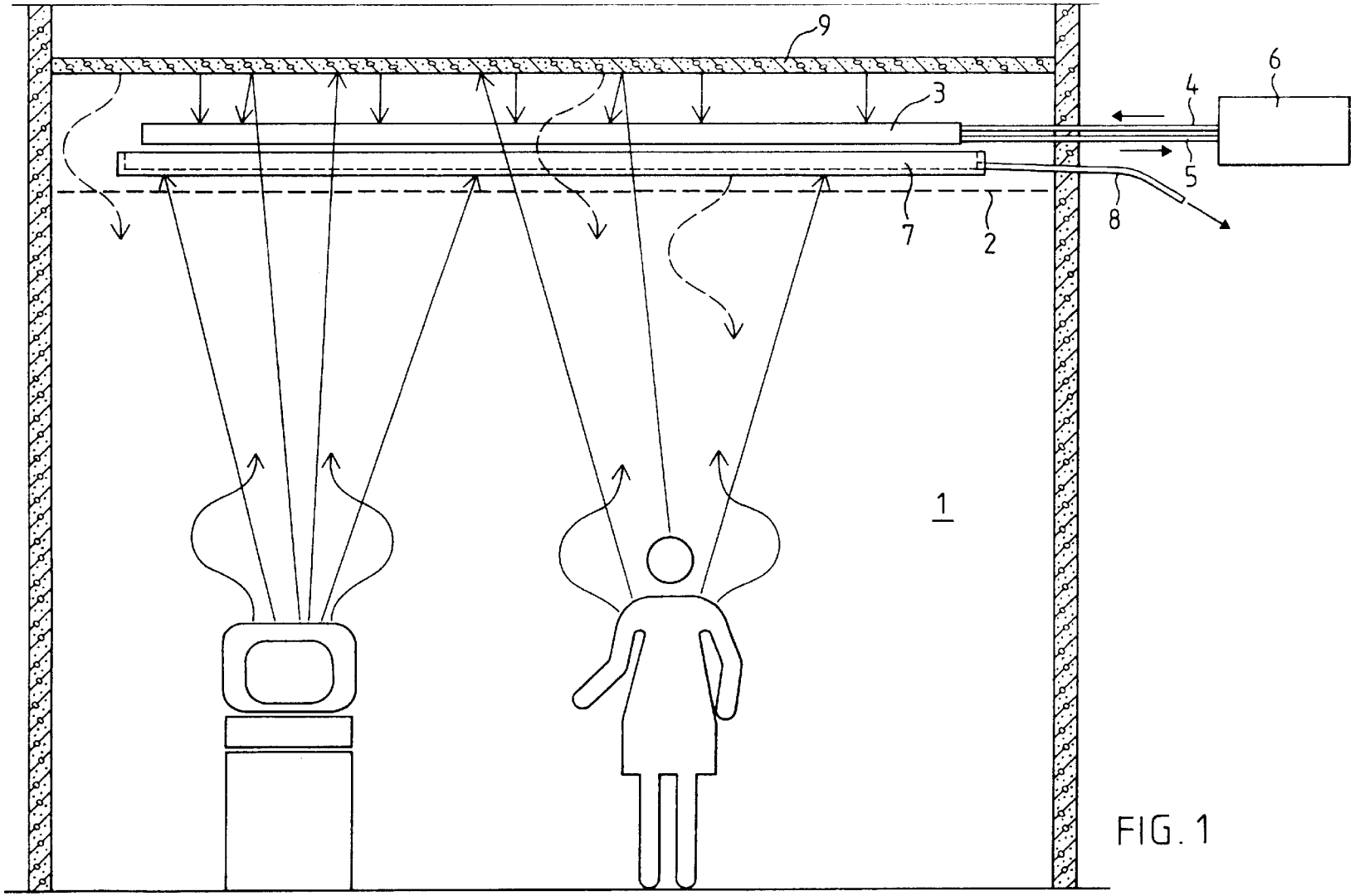
FIG. 1 is a cross section through a room which is climatically conditioned by the method according to the present invention.

A room 1 to be climatically conditioned (FIG. 1) usually contains heat-emitting objects, such as people and equipment, which exchange heat with a cooling apparatus through a perforated ceiling 2. The cooling apparatus includes at least one cooling element 3, which is connected by means of a feed line 4 and a draining line 5 directly or indirectly to a refrigerating unit 5. The cooling apparatus includes a condensate tray 7, which is arranged vertically below the cooling element 3, is of a slightly larger surface area than the cooling element and has a discharge 8. The cooling apparatus is preferably arranged above the perforated ceiling 2. It is also possible, however, to integrate the condensate tray 7 into the ceiling 2, for example in such a way that it replaces a ceiling panel. Above the cooling apparatus, preferably about 20–30 cm away from the cooling element, there is incorporated a ceiling or intermediate ceiling 9 of concrete or plaster.

During a cooling phase, the cooling element 3 is cooled below the freezing point, to at least −5° C., but preferably much lower, for example −40° C. Usually, condensate is then soon deposited on the cooling element, immediately turns to ice and is consequently bound to the cooling element. The cooling of the room 1 takes place predominantly by radiation exchange via the intermediate ceiling 9, which is intensely cooled by direct radiation exchange with the iced cooling element, since, in the infrared range, the ice cooling element is very similar to an ideal black body and absorbs very efficiently the radiation emanating from the intermediate ceiling 9, whereas for its part, on account of its low temperature, the iced cooling element radiates much less heat towards the intermediate ceiling 9.

On the other hand, the intermediate ceiling 9 exchanges heat radiation with the room 1, in particular with any heat-emitting objects in it, through the perforated ceiling 2. It absorbs part of the heat radiation emanating from these objects and, on account of the lower temperature of the intermediate ceiling, it radiates less heat than it absorbs. Part of the radiation reaching the intermediate ceiling 9 is, of course reflected and partly absorbed by the cooling element 3. The condensate tray 7 is also cooled by radiation exchange with the cooling element 3, and for its part, contributes to the cooling of the room 1 by radiation exchange with it. However, the temperature on the outside of the condensate tray 7 must not fall below the dew point, since otherwise condensate would form on its underside posing a potential problem to users of the room. The heat exchange by radiation is indicated in FIG. 1 by straight arrows.

In addition, convective heat exchange of the room 1 also occurs of course, in particular with the intermediate ceiling 9 but also directly with the cooling apparatus. In FIG. 1, this is indicated for the rising hot air by solid curved arrows and for the falling cold air by dashed curved arrows. However, the convection plays only a secondary role.

Due to the great temperature difference between the cooling element 3 and the room 1, which may well be 60° C., the cooling effect of the radiation exchange, which as known follows a $T^4$ law, is very high. As a result, an intense cooling effect can be achieved even with a small cooling element 3. Moreover, the air in the room 1 always remains relatively dry, since excess atmospheric moisture precipitates on the cooling element 3 and turns to ice. In this way, the most comfortable room conditions are established without further measures.

During a lengthy cooling phase, a relatively large amount of ice precipitates on the cooling element and ultimately has to be thawed and drained away during a regeneration phase, which is usually arranged to be performed at a time during which the room 1 is not being used. It is usually sufficient for thawing to simply switch off the refrigerating unit and to allow the ice deposited on the cooling element 3 to melt off by heat exchange with the surrounding atmosphere. It is also possible to perform a rapid regeneration by heating of the cooling element 3. The melted-off water is cooled by the condensate tray 7 and drained away via the discharge 8. After the ice has melted off completely, or possibly even only partially, the cooling apparatus is ready for use again.

According to a first embodiment of a cooling apparatus (FIGS. 2*a, b*), the cooling element 3 is designed as an evaporator made of sheet steel, which is connected via a heat-insulated feed line 4 and a similar draining line 5 to the refrigerating unit 6 (FIG. 1), which in this case is designed as a condenser. Liquid refrigerant, for example Freon, is channelled into the evaporator through the feed line, is evaporated in a meandering passage 10, connecting the feed line 4 to the draining line 5, and as a result cools the cooling element to about −40° C. The vapour is led by the draining line 5 back to the refrigerating unit 6 and is condensed there by heat extraction.

The condensate tray 7, arranged below the cooling element 3, has an outer shell 11 of steel, which is powder-coated on the outside, so that it absorbs well there to prevent formation of condensation, and an inner shell 12 of polyurethane or rockwool, or some other material of low thermal conductivity, which is inserted into the outer shell 11. On the inside, it is provided with a lining 11*a* of reflective metal foil. By the construction described, cooling of the outside of the condensation tray 7 below the dew point is generally prevented. If these measures are not sufficient, the outer shell 11 may be slightly heated. To facilitate drainage of condensate, the condensate tray 7 is made to slope slightly towards the discharge 8.

To facilitate the radiation exchange of the cooling element 3 with the room 1 via the intermediate ceiling 9, the cooling apparatus is arranged at a distance below the intermediate ceiling 9. The part of the intermediate ceiling 9 lying above the cooling element 3 is intensely cooled by radiation exchange with the cooling element and for its part cools the room 1 by radiation exchange. This effect is assisted by heat conduction in the intermediate ceiling 9. The radiation exchange with the intermediate ceiling 9 may—at least in the initial phase of a cooling phase when no ice layer has yet formed—be further intensified by the cooling element 3 being provided on the upper side with a coating which absorbs well. By contrast, its underside, facing the condensate tray 7, is preferably reflective.

Figure 3A:
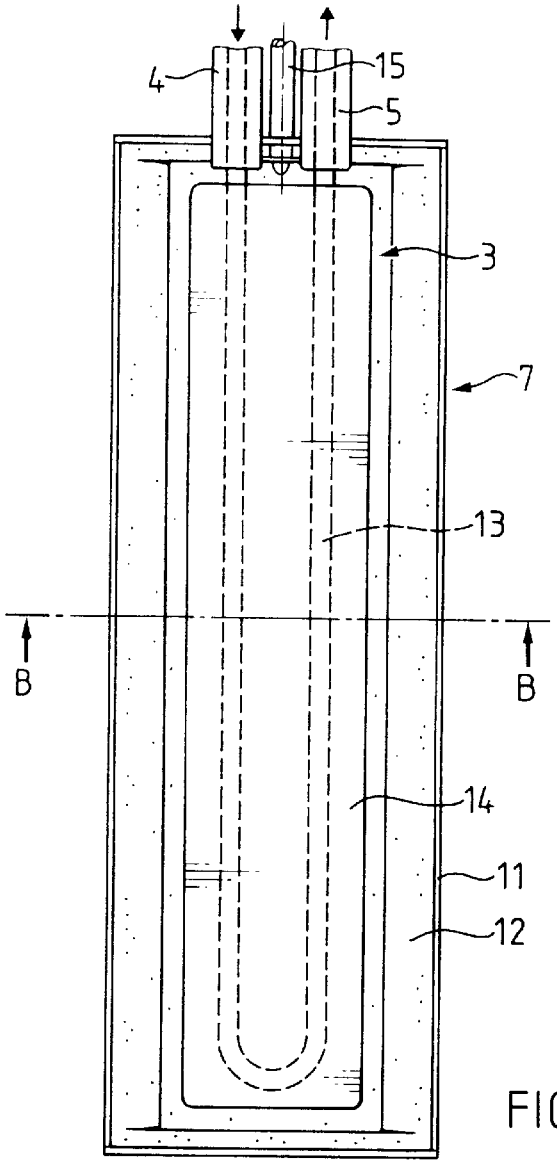
FIG. 3*a* is a plan view of a second embodiment of an apparatus according to the present invention for carrying out the method according to the invention.
Figure 3B:
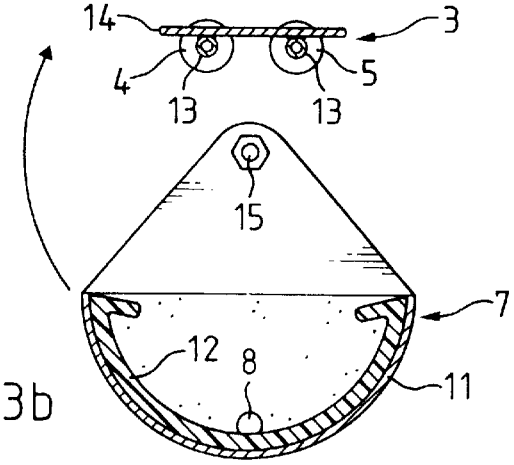
FIG. 3*b* is a cross-section along line B—B through the apparatus of FIG. 3*a,*
Figure 4A:
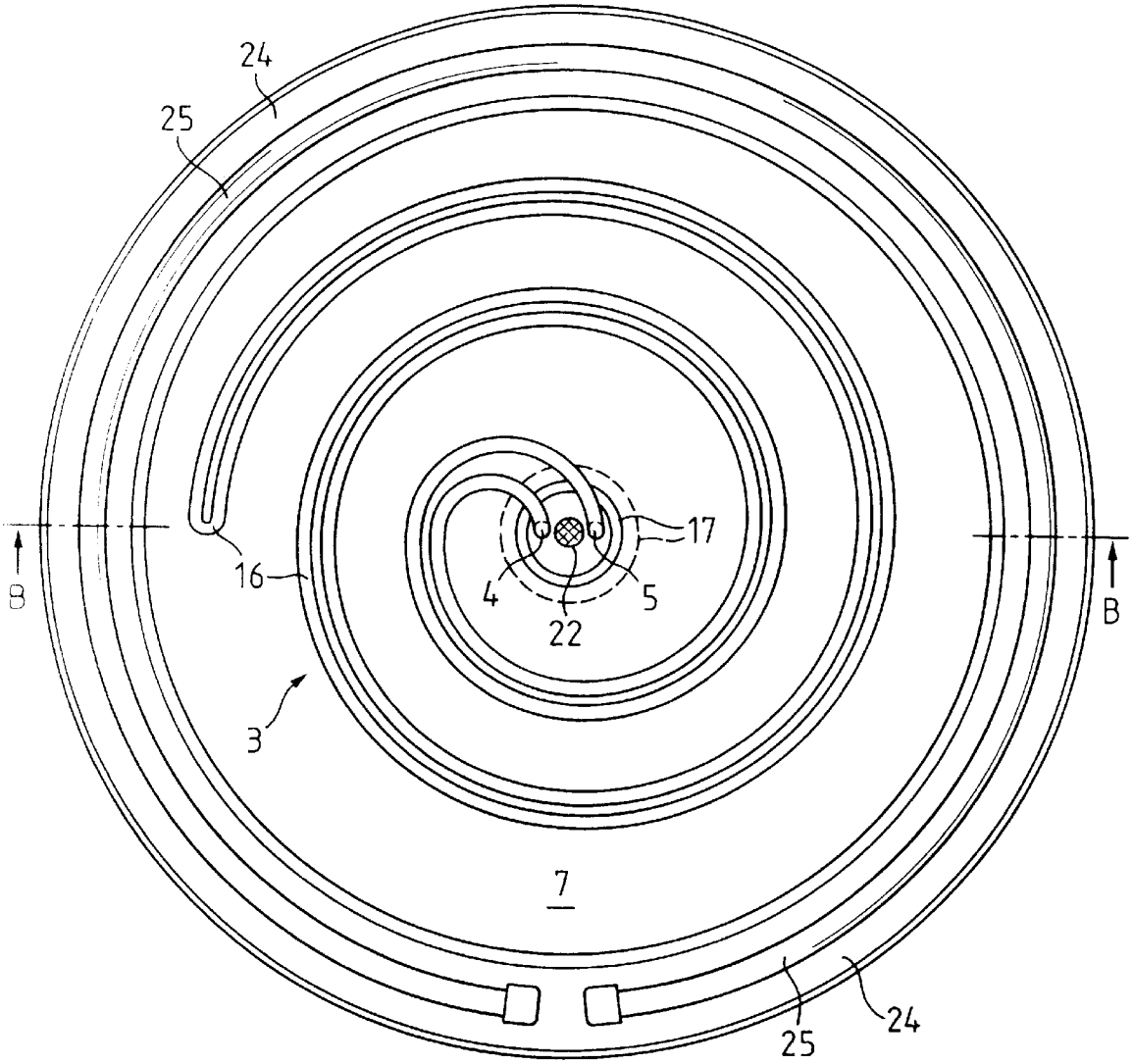
FIG. 4*a* is a plan view of a third embodiment of an apparatus according to the present invention for carrying out the method according to the invention.
Figure 4B:
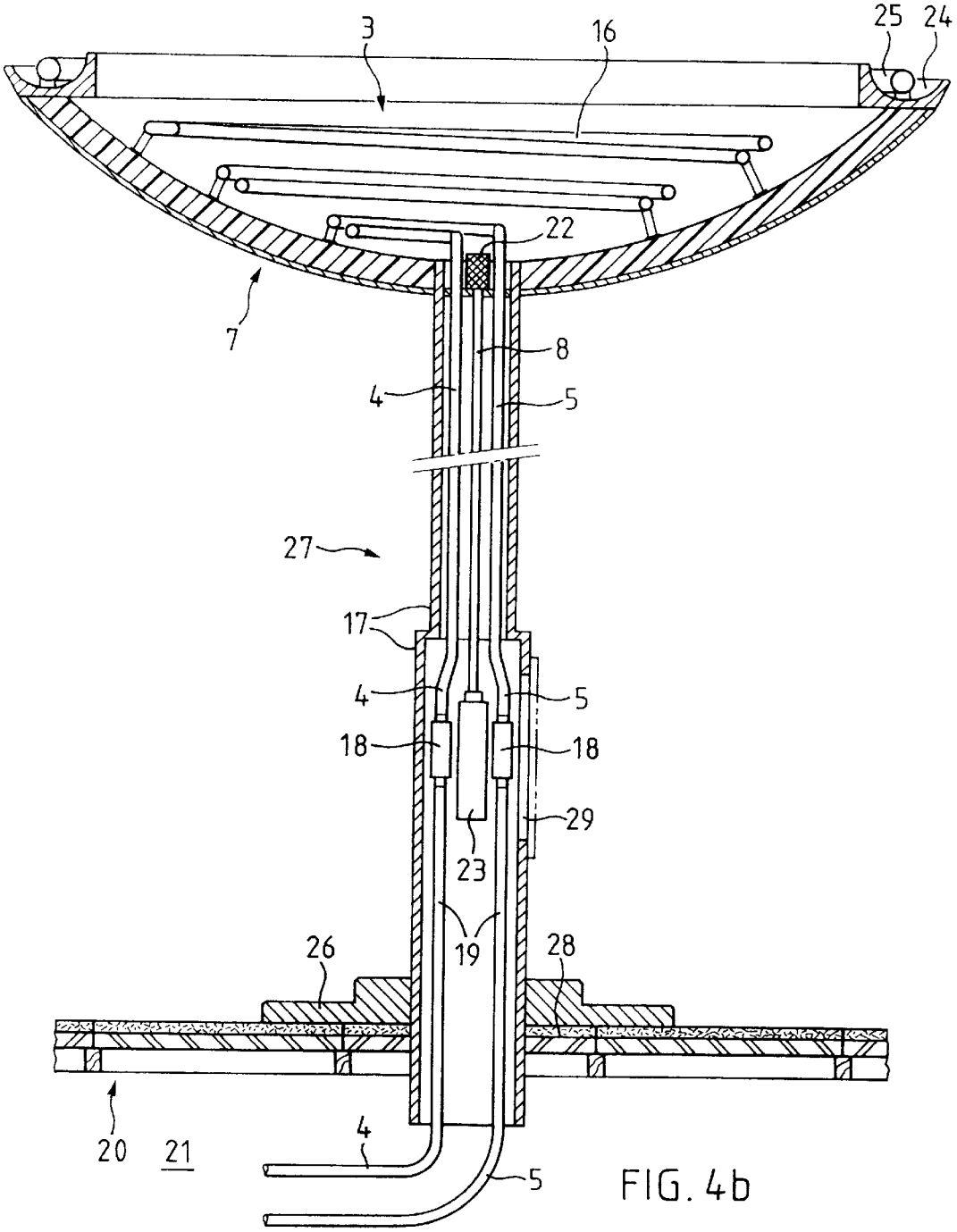
FIG. 4*b* is a cross-section along line B—B through the apparatus of FIG. 4*a*.

In the case of a second embodiment of the cooling apparatus (FIGS. 3*a, b*), the cooling element 3 is designed as a steel tube 13 bent in the shape of a U, through which brine cooled to about −40° C. in the refrigerating unit 6 (FIG. 1) is channelled. To intensify the radiation exchange with the intermediate ceiling 9, the steel tube 13 bears on the upper side a steel plate 14, to which it is welded. The steel plate may be coated matt-black on the upper side to enhance the cooling effect.

The condensate tray 7 is of basically the same construction as described in the first exemplary embodiment, but it maybe fastened on a pivotable spindle 15 extending parallel to its longitudinal axis, so that it can be pivoted to the side through about 90° (arrow) out of its position below the cooling element 3. The cooling element 3 is then exposed and can enter into direct radiation exchange with objects in the room 1. In this way, a particularly intense cooling effect can be achieved, as may be desired for example when cooling down an overheated room at the beginning of a cooling phase. The edges of the condensate tray 7 are bent inwardly slightly, so that any residual condensate cannot run out during pivoting of the tray.

According to a third embodiment of the cooling apparatus, the condensate tray 7 is designed as a flat dish of, for example, the shape of a spherical cup. The cooling element 3 is designed as part of a copper tube which is bent to form a double spiral 16 and, at the centre of the condensate tray 7, merges into a heat-insulated feed line 4 and a similar draining line 5, which are drawn into a further tube 17 made of sheet steel. At the outer end, the double spiral 16 may be provided with a venting valve. The ends of the copper tube 16 are adjoined there, via two rapid action couplings 18, to two likewise heat-insulated hoses 19, which are led through the tube 17 into a hollow floor 21, situated between a floor 20 and a concrete base (not shown), and are connected to permanently laid lines which establish the connection to the refrigerating unit 6 (FIG. 1) and carry brine or glycol as the cooling medium. Likewise arranged at the centre of the condensate tray 7 is a filter 22, which adjoins by a discharge 8 for the melted-off water resulting from the regeneration phase, and ends in a collecting tank 23. The condensate tray 7 is of basically the same construction as described in the first exemplary embodiment. However, it additionally bears a lighting element, a fluorescent tube 25, running around above a reflector 24, for indirect illumination. Of course, additional lighting elements may be provided for direct illumination.

The tube 17, together with a base plate 26 surrounding it, forms a stand 27, which bears the cooling element 3 and the condensate tray 7. The base plate 26 bears on the underside a base element 28, which can be used at various points of the floor 20, in that it replaces there a normal floor element, for example. Slightly above the base plate 26, the tube 17 has an opening 29, which can be closed by a cover and behind which the rapid action couplings 18 and the collecting tank 23 are situated and can be accessed.

In the case of this configuration, it is very easily possible to move the cooling apparatus elsewhere, by releasing the rapid action couplings 18 and lifting the stand 27 with the floor element 28 out of the floor 20 and replacing the element by a normal floor element. Subsequently, the cooling apparatus can be used at another point of the floor and be connected again via the rapid action couplings 18 to heat-insulated hoses, which establish the connection with permanently laid lines. This offers the possibility of assigning a single cooling apparatus to one workplace, for example, and moving it, if need be, with the workplace as well. It is then possible with comparatively low expenditure and, under certain circumstances, significantly reduced energy consumption, to produce a pleasant climate in the direct vicinity of the workplace, without it being necessary to cool the entire, possibly much larger, room. In the example described, a workplace light is integrated at the same time into the cooling apparatus, designed in this way as a workplace cooler. With the compact design of the cooling apparatus as a workplace cooler, use is made in a particularly advantageous way of the high cooling capacity which the method according to the invention offers.

The design described can be modified in a wide variety of ways. For instance, instead of the collecting tank 23, there may be provided a further rapid action coupling, which connects the discharge to a further hose and also to a condensate discharge provided in the hollow floor.

On the condensate tray there may be provided fixed and adjustable reflectors, arranged above the cooling element, or other deflecting elements for thermal radiation, for influencing the spatial distribution of the cooling effect, and possibly also deflecting elements for light.

A further modification is the use of an evaporator or Peltier element instead of the double spiral 16 as the cooling element. A Peltier element makes it unnecessary—in particular when a collecting tank is being used for the melted-off water which then needs only to be emptied occasionally—for the feed line 4 and the draining line 5 for connecting the cooling element to the refrigerating unit to be produced partly by hoses, and allows them instead to be formed entirely or partially as cables and to be connected by a plug connection, similar to an electrical plug connection, to a suitable cooling installation, which may have, for example in each room, a heat exchanger, from which the heat generated by the Peltier element or plurality of Peltier elements is abducted and transported to the refrigerating unit by means of cooling medium. In this case, the stand may be provided with a flat base, so that the cooling device can be moved around freely in the room like a standard lamp.

Although the use of a Peltier element as a cooling element is particularly advantageous in the case of a moveable workplace cooler, it is of course also possible in the case of fixed cooling apparatuses.

Other embodiments of the invention will be apparent to those skilled in the art from consideration of the specification and practice of the invention disclosed herein. It is intended that the specification and examples be considered exemplary only, with a true scope and spirit of the invention being indicated by the following claims.

We claim:

1. A method for climatically conditioning a room via radiant heat exchange, comprising:

providing at least one cooling element in radiant heat exchange relation with the room to be conditioned;

forming condensate into ice on the cooling element during a cooling phase;

maintaining the ice on the cooling element during the cooling phase to climatically condition the room via radiant heat exchange between the ice on the cooling element and the ambient air of the room being conditioned; and subsequently melting the ice during a regeneration phase.

2. The method of claim 1, further including alternating cooling phases with regeneration phases.

3. The method of claim 1, wherein cooling phases coincide to a great extent with times during which the climatically conditioned room is in use.

4. The method of claim 1, wherein regeneration phases generally coincide with times during which the room is not in use.

5. The method of claim 1, wherein cooling phases coincide to a great extent with times during which the climatically conditioned room is in use, and wherein regeneration phases generally coincide with times during which the room is not in use.

6. The method of claim 1, wherein during a regeneration phase, any melted-off condensate is caught and drained away.

7. The method of claim 1, wherein during a regeneration phase, the cooling element is switched off.

8. The method of claim 1, wherein during a cooling phase, the temperature of the cooling element is set to a temperature no greater than −2° C.

9. The method of claim 1, wherein during a cooling phase, the temperature of the cooling element is set to a temperature of approximately −40° C.

10. The method of claim 1, wherein during a cooling phase, the temperature of the cooling element is set to a temperature no greater than −5° C.

11. The method of claim 1, wherein the cooling element is arranged in the ceiling area of the room to be cooled.

12. The method of claim 11, wherein heat exchange between the cooling element and the room to be cooled takes place predominantly by radiation exchange via surface areas arranged above the cooling element.

13. The method of claim 1, wherein maintaining the ice includes maintaining the temperature of the cooling element to a temperature sufficiently low to freeze the condensate formed on the cooling element during the cooling phase.

14. A cooling apparatus for climatically conditioning a room via radiant heat exchange, comprising:

at least one cooling element for radiant heat exchange with the room to be conditioned; and a refrigerating unit for alternating operation of the cooling element between a cooling phase and a regeneration phase, wherein cooling phases occur primarily when the room to be conditioned is in use and regeneration phases occur primarily when the room to be conditioned is not in use;

wherein during the cooling phase the temperature of the cooling element is set at a temperature sufficiently low to freeze any condensate formed on the cooling element and to maintain the frozen condensate as ice on the cooling element during the cooling phase, such that radiant heat exchange between the ice on the cooling element and the ambient air of the room being conditioned climatically conditions the room.

15. The cooling apparatus of claim 14, wherein during a regeneration phase the temperature of the cooling element is set at a temperature sufficiently high to melt off any condensate frozen to the cooling element.

16. The cooling apparatus of claim 14, wherein the refrigerating unit maintains the temperature of the cooling element at a temperature between about −5° C. and about −40° C. during the cooling phase.

17. The cooling apparatus of claim 14, further including a condensate tray arranged below the cooling element to catch and drain away condensate melted off the cooling element during the regeneration phase.

18. A cooling apparatus for climatically conditioning a room primarily by radiant heat exchange, comprising:

at least one cooling element for radiant heat exchange with the room to be conditioned;

a refrigerating unit for providing a cooling phase operation by setting and maintaining the temperature of the cooling element sufficiently low to freeze any condensate formed on the cooling element; and a condensate tray arranged beneath the cooling element such that an inner surface of the condensate tray faces the cooling element, wherein the condensate tray includes an inner reflective surface, an outer absorbent surface for preventing condensation formation, and an insulation layer between the inner and outer surfaces to thermally insulate the inner surface from the outer surface.

19. The cooling apparatus of claim 18, wherein the condensate tray can be at least partially pivoted or pushed out of the area lying vertically below the cooling element.

20. The cooling apparatus of claim 18, wherein the cooling element is connected to the refrigerating unit via a feed line and a draining line which are at least partially of a flexible design.

21. The cooling apparatus of claim 18, wherein the cooling element is designed as a tube, as an evaporator or as a Peltier element.

22. A cooling apparatus for climatically conditioning a room by radiant heat exchange, comprising:

at least one cooling element for radiant heat exchange with the room to be climatically conditioned;

a refrigerating unit for providing a cooling phase operation by setting and maintaining the temperature of the cooling element sufficiently low to freeze any condensate formed on the cooling element;

a condensate tray arranged beneath the cooling element such that an inside surface of the condensate tray faces the cooling element, wherein an outside surface of the condensate tray is thermally insulated from the inside surface; and a floor-supported stand which supports both the at least one cooling element and the condensate tray.

23. The cooling apparatus of claim 22, wherein the outside of the condensate tray is of an absorbent design.

24. The cooling apparatus of claim 22, wherein the inside of the condensate tray is of a reflective design.

25. The cooling apparatus of claim 22, wherein the cooling element is of an absorbent design on the upper side and a reflective design on the underside, facing the condensate tray.

26. The cooling apparatus of claim 22, wherein the cooling element is connected to the refrigerating unit via a feed line and a draining line which are at least partially of a flexible design.

27. The cooling apparatus of claim 22, wherein the cooling element is designed as a tube, as an evaporator or as a Peltier element.

28. A cooling apparatus for climatically conditioning a room by radiant heat exchange, comprising:

at least one cooling element for cooling a room by radiant heat exchange, wherein the cooling element is designed as a tube, as an evaporator, or as a Peltier element;

partially flexible feed and drain lines for connecting the cooling element to a refrigerating unit, the refrigerating unit providing a cooling phase operation by setting and maintaining the temperature of the cooling element sufficiently low to freeze any condensate formed on the cooling element; and a condensate tray arranged beneath the cooling element such that an inside surface of the condensate tray faces the cooling element, wherein an outside surface of the condensate tray is thermally insulated from the inside surface; and a floor-supported stand which supports both the at least one cooling element and the condensate tray.

* * * * *